US011229942B2

(12) United States Patent
Watanabe et al.

(10) Patent No.: US 11,229,942 B2
(45) Date of Patent: Jan. 25, 2022

(54) JOINING METHOD AND JOINT STRUCTURE OF MEMBERS

(71) Applicant: Kobe Steel, Ltd., Hyogo (JP)

(72) Inventors: Kenichi Watanabe, Kobe (JP); Toru Hashimura, Kobe (JP); Junya Naitou, Kobe (JP); Yasuhiro Maeda, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 607 days.

(21) Appl. No.: 16/084,506

(22) PCT Filed: Feb. 21, 2017

(86) PCT No.: PCT/JP2017/006309
§ 371 (c)(1),
(2) Date: Sep. 12, 2018

(87) PCT Pub. No.: WO2017/169298
PCT Pub. Date: Oct. 5, 2017

(65) Prior Publication Data

US 2019/0070656 A1 Mar. 7, 2019

(30) Foreign Application Priority Data

Mar. 29, 2016 (JP) ..... JP2016-066139

(51) Int. Cl.
*B21D 39/06* (2006.01)
*B21D 39/20* (2006.01)
*B21D 39/04* (2006.01)

(52) U.S. Cl.
CPC ..... *B21D 39/06* (2013.01); *B21D 39/046* (2013.01); *B21D 39/20* (2013.01); *B21D 39/206* (2013.01); *B21D 39/203* (2013.01)

(58) Field of Classification Search
CPC ..... B21D 39/06; B21D 39/20; B21D 39/203; B21D 39/206; B21D 39/046
See application file for complete search history.

(56) References Cited

FOREIGN PATENT DOCUMENTS

GB 2024681 A * 1/1980 ..... B21D 39/206
JP S51-133170 A 11/1976
(Continued)

OTHER PUBLICATIONS

Notification of Transmittal of Translation of the International Preliminary Report on Patentability and Translation of Written Opinion of the International Searching Authority; PCT/JP2017/006309; dated Oct. 2, 2018.
(Continued)

*Primary Examiner* — Jermie E Cozart
(74) *Attorney, Agent, or Firm* — Studebaker & Brackett PC

(57) ABSTRACT

Disclosed is a joining method of members, which includes the steps of: preparing a first member in which a first hole portion having a polygonal cross-sectional shape is formed, and a second member having a hollow shape, wherein the second member has a cross-sectional shape corresponding to the polygonal cross-sectional shape of the first hole portion, the second member including a plurality of straight line portions extending linearly and corner portions positioned between the adjacent two straight line portions in the cross-sectional shape; inserting the second member into the first hole portion of the first member; and caulking and joining the second member to the first member by enlarging and deforming the corner portions.

5 Claims, 8 Drawing Sheets

(56) References Cited

FOREIGN PATENT DOCUMENTS

| | | | |
|---|---|---|---|
| JP | 2007-284039 | A | 11/2007 |
| JP | 2007-319919 | A | 12/2007 |
| JP | 2010-046697 | A | 3/2010 |

OTHER PUBLICATIONS

International Search Report issued in PCT/JP2017/006309, dated Apr. 4, 2017.

* cited by examiner

JOINING METHOD AND JOINT STRUCTURE OF MEMBERS

CROSS-REFERENCE TO RELATED APPLICATIONS

This is a national phase application in the United States of International Patent Application No. PCT/JP2017/006309 with an international filing date of Feb. 21, 2017, which claims priority of Japanese Patent Application No. 2016-066139 filed on Mar. 29, 2016. The contents of this application are incorporated herein by reference.

TECHNICAL FIELD

The present invention relates to a joining method of members and a joint structure of members.

BACKGROUND ART

A high-tensile-strength steel sheet, called high tension steel, is used in structural members of automobiles. Such high tension steel is effective in reducing the weight and improving the safety of the structural member, but is still heavier than a low-specific-gravity material, such as aluminum. The high tension steel, due to its high strength, has problems, including reduction in formability, increase in forming load, and reduction in dimensional accuracy. To counter these problems, multi-materialization has been recently carried out, which involves utilizing a combination of a steel component and an extruded product, a cast product, or a press-formed product, which is made of aluminum with a lower specific gravity than a steel sheet.

Joining between a steel sheet component and an aluminum component is an issue for the multi-materialization. In welding techniques typified by spot welding, a brittle intermetallic compound (IMC) is formed at the interface between the steel sheet and the aluminum sheet. Owing to this, other joining techniques, such as electromagnetic forming joining, screw fastening typified by bolts and nuts, friction stir welding (FSW), rivets, self-piercing rivet (SPR), mechanical clinching, and bonding, have been employed into practical use.

In caulking by the electromagnetic forming, a solenoid forming coil is inserted into a pipe-shaped component that is designed to be fitted into a mating component, and then an impulse current is passed through the coil to change the magnetic field, whereby an induced current is generated in the pipe-shaped conductor component. An electromagnetic force results from the interaction between the magnetic field formed by the primary current of the coil and the induced current flowing in the opposite direction along the circumferential direction of the pipe-shaped component. At this time, the pipe-shaped component receives the force directed outward and thereby is enlarged and deformed to be caulked and joined to the mating component. This joining method is suitable for copper and aluminum as they have high electrical conductivity, and hence it has been put into practical use for the joining of some automobile parts.

JP 2007-284039 A discloses a caulking joining technique through electromagnetic forming for multi-materialization. In the technique mentioned in JP 2007-284039 A, a bumper reinforcement formed of metal and having a hollow cross section is enlarged and deformed by the electromagnetic forming to be fitted into and joined to a hole provided in a bumper stay that is formed of an aluminum alloy.

DISCLOSURE OF THE INVENTION

Problems to be Solved by the Invention

The electromagnetic forming mentioned in JP 2007-284039 A and other joining methods are required to improve the joining strength between members. To improve the joining strength, it is preferable that the strength of the member itself is enhanced. To this end, an increase in the hardness of material or in the thickness of the member can be proposed. However, the increase in the hardness of the member increases the risk of crack formation in the member on impact, and also the increase in the thickness of the member increases the weight of a component including the member. Alternatively, to improve the joining strength, the joint portion is also proposed to be subjected to a process, such as burring. However, the burring process is sometimes difficult to perform on account of the shape of the joint portion. Even if the shape of the joint portion is one that is suitable for the burring process, the execution of the burring process leads to an increase in the number of manufacturing steps and also to an increase in the manufacturing cost of the joint portion. In addition, joining using electromagnetic forming has difficulty in enlarging a member having a polygonal cross-section and caulking and joining the member to a mating member.

Accordingly, it is an object of the present invention to provide a joining method and joint structure of members which can improve a joining strength therebetween while suppressing an increase in the weight of the members when joining the two members by enlarging one of these members that has a polygonal cross section.

Means for Solving the Problems

A first aspect of the present invention provides a joining method of members, which includes the steps of:

preparing a first member in which a first hole portion having a polygonal cross-sectional shape is formed, and a second member having a hollow shape, wherein the second member has a cross-sectional shape corresponding to the polygonal cross-sectional shape of the first hole portion, the second member including a plurality of straight line portions extending linearly and a corner portion positioned between the adjacent two straight line portions in the cross-sectional shape;

inserting the second member into the first hole portion of the first member; and caulking and joining the second member to the first member by enlarging and deforming the corner portion.

With the above-mentioned configuration, the joining strength between the members can be improved by enlarging and deforming the corner portion, which has a higher caulking holding force than the straight line portion.

In particular, as the number, size, or weight of the members is not increased or another member is not added, the joining strength between the members can be improved without increasing the weight of the members.

The polygonal cross-sectional shape of the first hole portion only needs to have a shape that includes straight line portions and a corner portion. Further, the corner portion of the first hole portion may be one having an arc shape or one having a vertex with a predetermined angle. The cross-sectional shape of the second member corresponding to the polygonal cross-sectional shape of the first hole portion only needs to have any shape which enables the second member to be inserted into the first hole portion having the polygonal cross-sectional shape and which has straight line portions corresponding to the straight line portions of the first hole portion and a corner portion corresponding to the corner portion of the first hole portion. The corner portion of the second member may be one having an arc shape or one having a vertex with a predetermined angle.

The first aspect preferably further includes the following configurations.

(1) An elastic body is disposed in the corner portion of the second member, and the corner portion is enlarged and deformed by compressing the elastic body in a direction of the insertion of the second member.

(2) The straight line portion of the second member has a length that is equal to or more than a first length, and a core member is disposed at the straight line portion.

(3) In the above-mentioned configuration (2), the first length is equal to an effective width B of the first member, the effective width B is determined by formula (1) below, and a length C of the core member in a longitudinal direction of the straight portion is determined by formula (3) below:

[Equation 1]

$$B=\alpha\times\sqrt{E\times t/\sigma y} \quad (1)$$

$$0.9\leq\alpha\leq1.1 \quad (2)$$

$$C\geq L-B \quad (3)$$

where α is specified by formula (2), E is a Young's modulus of the first member, t is a plate thickness of the first member, σy is a yield stress of the first member, and L is a length of the straight line portion.

(4) In the above-mentioned configuration (1), the elastic body is disposed in at least a joint portion between the first member and the second member in the corner portion.

With the above-mentioned configuration (1), the corner portion is enlarged and deformed using the elastic body disposed in the corner portion, so that the corner portion can be uniformly deformed. Consequently, the fitting accuracy between the first member and the second member is improved, thereby making it possible to improve the joining strength therebetween.

With the above-mentioned configuration (2), by arranging the core member at the straight line portion that has a predetermined length or more, the corner portion having a higher caulking holding force than the straight line portion is deformed concentratedly without deforming the straight line portion which is more likely to elastically buckle by an in-plane compressive force generated at the time of caulking. Thus, the joining strength can be improved.

With the above-mentioned configuration (3), when the length of the straight line portion is larger than the effective width of the first member, the first member is more likely to elastically buckle in the region spaced away from each of both ends of the straight line portion only by half the effective width, i.e., ½ of the effective width. Because of this, the core member is arranged in this region, thereby preventing the second member from being enlarged and deformed in the region, which can also prevent the first member from elastically buckling in the region.

With the above-mentioned configuration (4), the region where the elastic body is arranged is located in at least the joint portion between the first member and the second member, thereby making it possible to reduce the necessary amount of the elastic body. Furthermore, the size of the elastic body is set smaller, so that the corner portion can be uniformly and more easily deformed using the elastic body.

A second aspect of the present invention is characterized by a joint structure of members between a first member having a first hole portion and a second member having a hollow shape, the second member being inserted into the first hole portion, wherein the first hole portion has a polygonal cross-sectional shape, the second member has a cross-sectional shape corresponding to the polygonal cross-sectional shape of the first hole portion, the second member including a plurality of straight line portions extending linearly and a corner portion positioned between the adjacent two straight line portions in the cross-sectional shape, and an amount of enlarged deformation of the second member in at least the one corner portion is larger than an amount of enlarged deformation of the second member in the straight line on at least one side.

With the above-mentioned configuration, the amount of enlarged deformation of the corner portion having a higher caulking holding force than the straight line portion is increased, thereby making it possible to improve the joining strength of the members. In particular, as the number, size, or weight of the members is not increased or another member is not added, the joining strength between the members can be improved without increasing the weight of the members.

In short, according to the present invention, the joining method and joint structure of members can be provided that improves a joining strength therebetween while suppressing an increase in the weight of the members when joining the two members by enlarging one of these members that has a polygonal cross section.

MODE FOR CARRYING OUT THE INVENTION

Embodiments of the present invention will be described below with reference to the accompanying drawings. Although in the description below, terms indicative of directions and positions (e.g., "upper side", "lower side", and the like) are used in some cases, these terms are to make the invention easy to understand and do not limit the technical scope of the present invention by their meanings. Furthermore, the following description is illustrative of the embodiments of the present invention only, and is not intended to limit the present invention and applied products or applications thereof.

Although in the respective embodiments illustrated below, materials of individual members are exemplified, the materials of the individual members are not particularly limited to the exemplified ones in all embodiments. The present invention can be applied to arbitrary materials. For example, the first and second members both are formed of iron only, aluminum alloys only, or a combination of iron and an aluminum alloy and the like.

First Embodiment

Figure 1:
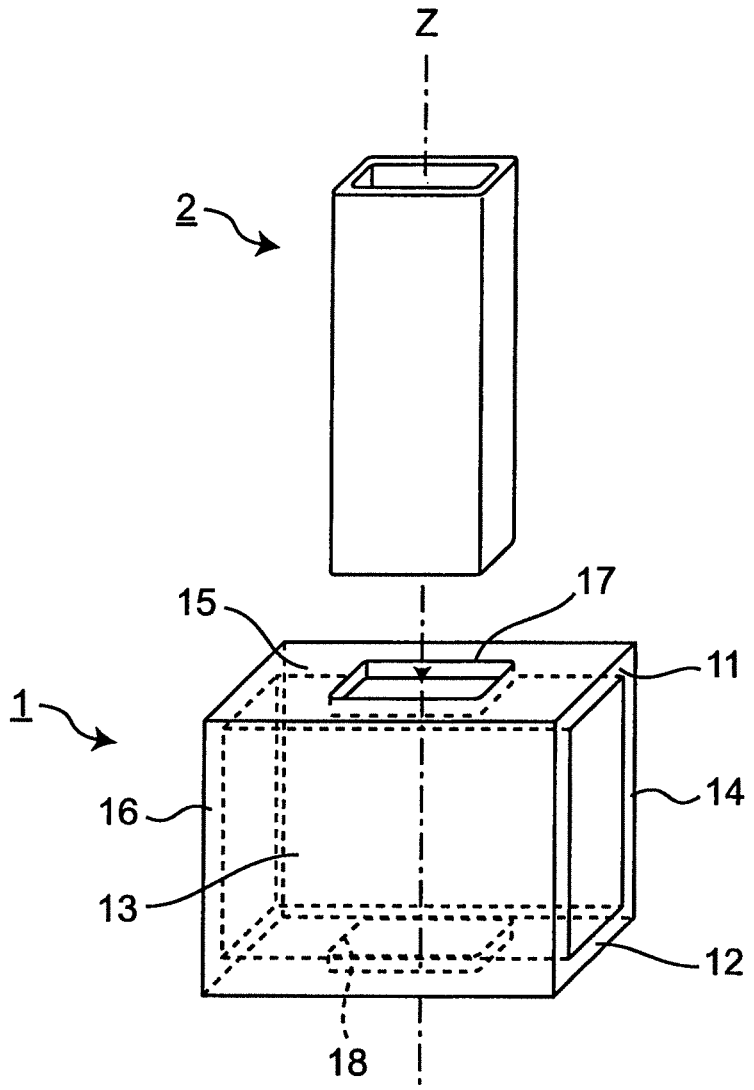
FIG. 1 is a perspective view illustrating joining between a first member and a second member according to a first embodiment of the present invention.

FIG. 1 is a perspective view illustrating joining between a first member and a second member according to a first embodiment of the present invention. As shown in FIG. 1, in the present embodiment, a second member 2 is inserted into a first member 1 to join the first member 1 and the second member 2 together. The first member 1 is formed of, for example, high tension steel, and has a hollow rectangular parallelepiped shape. The first member 1 has an upper wall 11, a lower wall 12, and a plurality of side walls 13 to 16 connecting the upper wall 11 and the lower wall 12. First hole portions 17 and 18 through which the second member 2 is insertable are provided in the upper wall 11 and the lower wall 12, respectively. The side wall 14 and the side wall 16 have respective holes formed in a direction orthogonal to the direction in which the second member 2 is inserted.

Figure 2:
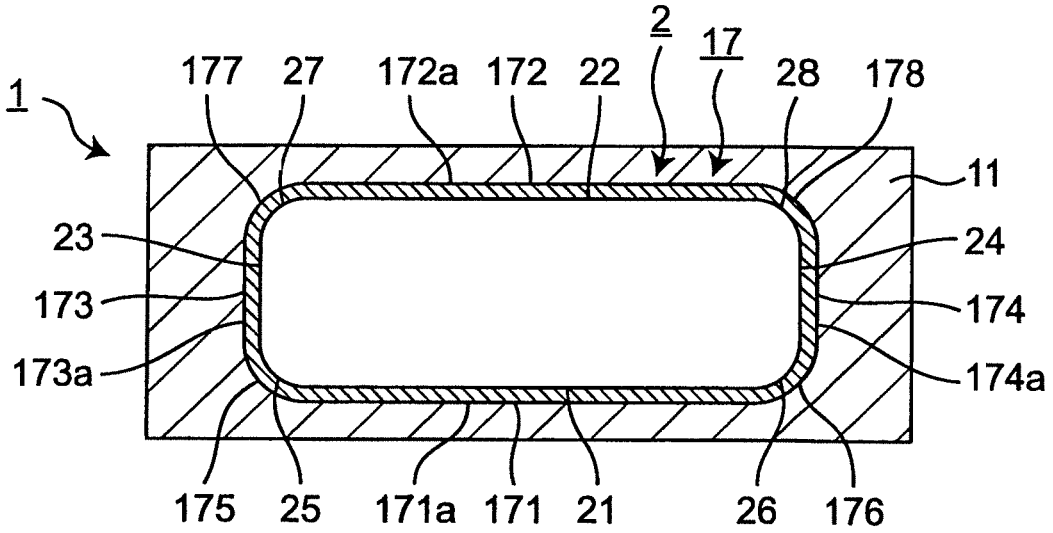
FIG. 2 is a cross-sectional view showing a horizontal cross-section of a first hole portion in a state where the second member is inserted into the first member.

FIG. 2 is a cross-sectional view showing a horizontal cross-section of the first hole portion 17 in a state where the second member 2 is inserted into the first member 1. As shown in FIG. 2, the first hole portion 17 has a rectangular cross-sectional shape that has long sides 171 and 172 and short sides 173 and 174. The long sides 171 and 172 include straight line portions 171*a* and 172*a* extending linearly, respectively. The short sides 173 and 174 include straight line portions 173*a* and 174*a* extending linearly, respectively. The first hole portion 17 includes a corner portion 175 positioned between the straight line portion 171*a* and the straight line portion 173*a*, a corner portion 176 positioned between the straight line portion 171*a* and the straight line portion 174*a*, a corner portion 177 positioned between the straight line portion 172*a* and the straight line portion 173*a*, and a corner portion 178 positioned between the straight line portion 172*a* and the straight line portion 174*a*. The four corner portions 175 to 178 each have an arc shape with the same curvature. It is noted that the first hole portion 18 has the same shape as the first hole portion 17.

The second member 2 is formed of, for example, an aluminum alloy. The second member 2 has a hollow rectangular parallelepiped shape with their corners formed in an arc shape and extends in an axis Z direction. The axis Z passes through the center of the second member 2 and the centers of the first hole portions 17 and 18 of the first member 1. The axis Z direction coincides with the insertion direction in which the second member 2 is inserted into the first member 1.

The second member 2 also has a rectangular cross-sectional shape corresponding to the rectangular cross-sectional shape of each of the first hole portions 17 and 18 so as to be insertable into the first hole portions 17 and 18. Specifically, the cross-sectional shape of the second member 2 is similar to the cross-sectional shape of each of the first hole portions 17 and 18, and is slightly smaller than the cross-sectional shape of each of the first hole portions 17 and 18.

The second member 2 includes straight line portions 21 to 24 extending linearly, and corner portions 25 to 28 positioned between the two straight line portions in the cross-sectional shape. In a state where the second member 2 is inserted into the first hole portions 17 and 18, the straight line portion 21 faces the straight line portion 171*a*, the straight line portion 22 faces the straight line portion 172*a*, the straight line portion 23 faces the straight line portion 173*a*, and the straight line portion 24 faces the straight line portion 174*a*. In the same state, the corner portion 25 faces the corner portion 175, the corner portion 26 faces the corner portion 176, the corner portion 27 faces the corner portion 177, and the corner portion 28 faces the corner portion 178. The four corner portions 25 to 28 each have an arc shape with the same curvature.

Each of the straight line portions 21 and 22 on the long side has a length that is equal to or more than a first length, and each of the straight line portions 23 and 24 on the short side has a length less than the first length. The first length is equal to an effective width B of the first member 1.

The effective width B of the first member 1 is determined by formula (1) below:

[Equation 2]

$$B=\alpha\times\sqrt{E\times t/\sigma y} \quad (1)$$

$$0.9\leq\alpha\leq1.1 \quad (2)$$

where $\alpha$ is specified by the formula (2), E is a Young's modulus of the first member 1, t is a plate thickness of the first member 1, and $\sigma y$ is a yield stress of the first member 1.

It is noted that in the formula (1), the effective width B of the first member 1 is specified by the Karman equation on the assumption that the first member 1 buckles elastically when the yield stress is reached.

Joining between the first member 1 and the second member 2 is performed in the following way.

Figure 3:
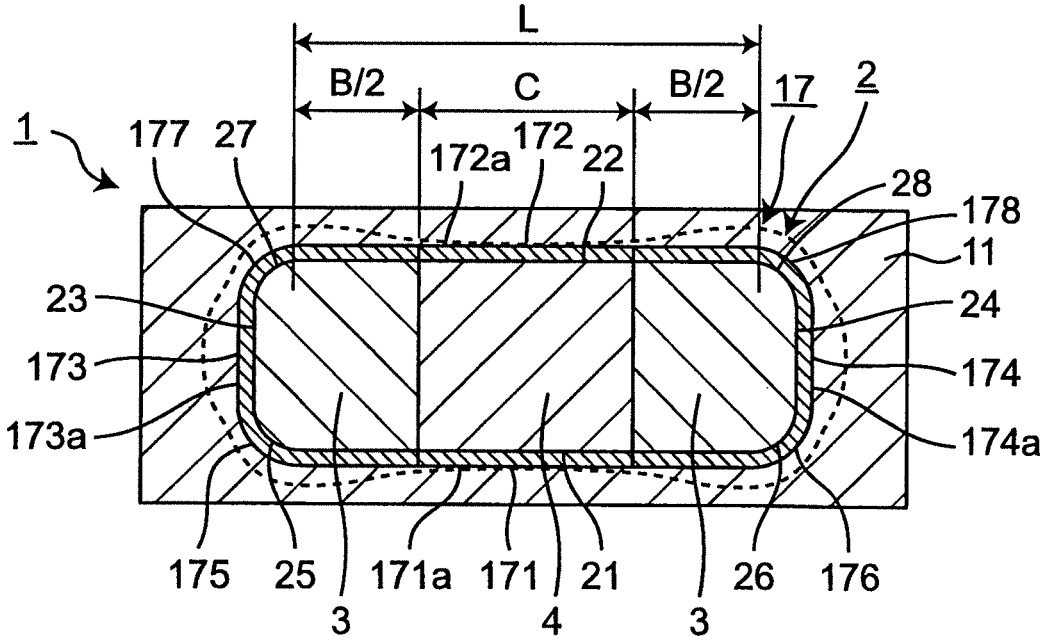
FIG. 3 is a cross-sectional view showing a horizontal cross-section of the first hole portion in a state where the second member is inserted into the first member, and further, elastic bodies and a core member are inserted into the interior of the second member.

First, as shown in FIG. 1, the second member 2 is inserted into the first hole portions 17 and 18 of the first member 1. Further, the elastic bodies 3 and the core member 4 are inserted into the interior of the second member 2. FIG. 3 is a cross-sectional view showing a horizontal cross-section of the first hole portion 17 in a state where the second member 2 is inserted into the first member 1, and further, the elastic bodies 3 and the core member 4 are inserted into the interior of the second member 2. As shown in FIG. 3, the elastic bodies 3 are disposed in the corner portions 25 to 28 of the second member 2, and the core member 4 is disposed at the straight line portions 21 and 22 on the long side, each straight line portion having a length equal to or more than the first length (effective width B of the first member 1). In particular, the core member 4 is disposed at the center in the longitudinal direction of the straight line portions 21 and 22 on the long side.

The length C of the core member 4 in the longitudinal direction of each of the straight line portions 21 and 22 is determined by formula (3) below:

[Equation 3]

$$C \geq L - B \quad (3)$$

where L is a length of each of the straight line portions 21 and 22.

The core member 4 is formed of, for example, steel. The core member 4 may be formed of the same material as the first member 1, or may be a different material from the first member 1.

Figure 4:
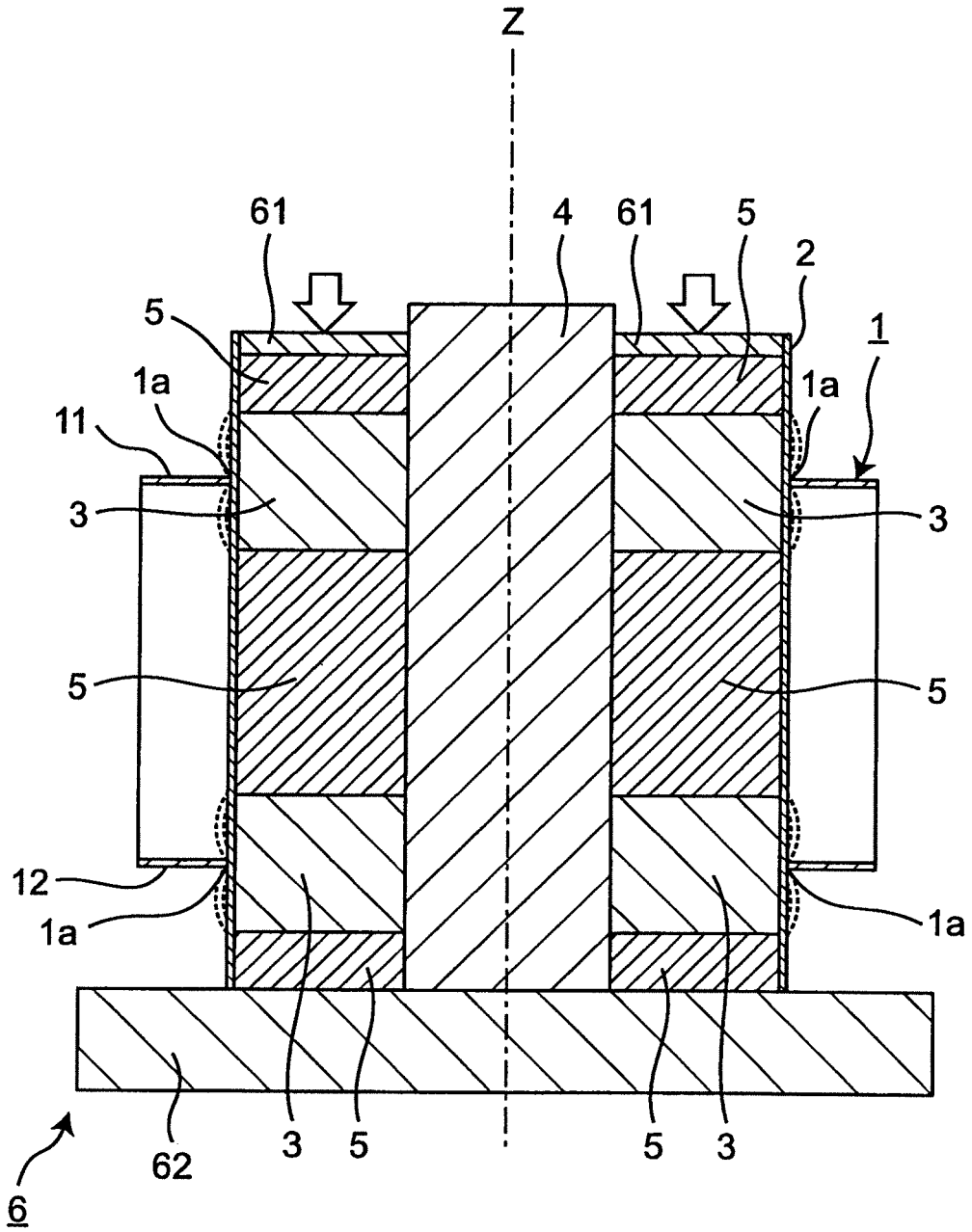
FIG. 4 is a longitudinal cross-sectional view of the first member and the second member in a state where the second member is inserted into the first member, and further, the elastic bodies and the core member are inserted into the interior of the second member.

FIG. 4 is a longitudinal cross-sectional view of the first member 1 and the second member 2 in a state where the second member 2 is inserted into the first member 1, and further, the elastic bodies 3 and the core member 4 are inserted into the interior of the second member 2. As shown in FIG. 4, the second member 2 passes through the first member 1. Further, and the elastic bodies 3 are separated into top and bottom parts and arranged to extend by a predetermined length along the insertion direction (axis Z direction) of the second member 2 and to cover the joint portions 1*a* between the first member 1 and the second member 2 in the corner portions 25 to 28. Core members 5 are respectively disposed above the elastic bodies 3 on the upper side, between the elastic bodies 3 on the upper side and the lower side, and below the elastic bodies on the lower side. Note that the core member 5 is not disposed at the joint portion 1*a* between the first member 1 and the second member 2. The core member 5 is formed of the same material as the core member 4 disposed at the straight line portions 21 and 22.

Each elastic body 3 can expand outward by receiving a compressive force to enlarge and deform the second member 2, and includes, for example, an encapsulating member in which rubber, gas, or liquid is encapsulated. It is noted that the elastic body 3 is preferably a member that is uniformly deformed when expanding outward in response to the compressive force.

When the elastic body 3 is formed of rubber, suitable material of the rubber preferably is, for example, any of urethane rubber, chloroprene rubber, CNR rubber (chloroprene rubber+nitrile rubber), or silicone rubber. The hardness of these rubbers is preferably 30 or more in terms of Shore A.

It is noted that the second member 2 may be inserted into the first hole portions 17 and 18 in a state where the elastic bodies 3 and the core members 4 and 5 are inserted into the second member 2.

Then, the second member 2 into which the elastic bodies 3 and the core members 4 and 5 are inserted is set in a press device 6. The press device 6 includes an indenter 61 and a stand 62. The indenter 61 has a flat lower surface. The indenter 61 presses, with its lower surface, the elastic bodies 3 via the core members 5. The stand 62 has a flat upper surface. The elastic bodies 3 are placed on the upper surface of the stand 62 via the core members 5.

Then, an external compressive force is applied to the elastic bodies 3 in the axis Z direction by the press device 6. As the dimension in the axis Z direction of the elastic body 3 decreases, the dimension in the radial direction of the elastic body 3 increases. In this manner, each elastic body 3 is elastically deformed (expanded) outward from the axis Z, and as a result, the second member 2 into the interior of which the elastic bodies 3 are inserted is enlarged and deformed.

After the first member 1 and the second member 2 are joined together, the compressive force of the press device 6 is released. The elastic bodies 3 from which the compressive force has been released are restored to their original shape by their own elastic force, and are then removed from the second member 2. The core members 4 and 5 are also removed from the second member 2.

FIGS. 3 and 4 show, by dashed lines, a state in which the second member 2 is enlarged and deformed with respect to the first member 1 after the removal of the elastic bodies 3. As shown in FIG. 3, the amount of enlarged deformation of the second member 2 in the corner portions 25 to 28 is larger than the amount of enlarged deformation of the second member 2 in the straight line portions 21 and 22 on the long side. In more detail, the amount of enlarged deformation of the second member 2 toward the first member 1 decreases from the corner portions 25 to 28 toward the center in the longitudinal direction of the straight line portions 21 and 22 on the long side.

It should be noted that as the core member 4 is not disposed at the straight line portions 23 and 24 on the short side, the amount of enlarged deformation of the second member 2 in the corner portions 25 to 28 is smaller than the amount of enlarged deformation of the second member 2 in the straight line portions 23 and 24 on the short side. In more detail, the amount of enlarged deformation of the second member 2 toward the first member 1 increases from the corner portions 25 to 28 toward the center in the longitudinal direction of the straight line portions 23 and 24 on the short side.

According to the joining method and joint structure between the first member 10 and the second member 20 with the above-mentioned configuration, the following effects can be exhibited.

The joining strength between the first member 1 and the second member 2 can be improved by enlarging and deforming the corner portions 25 to 28, which have a higher caulking holding force than the straight line portions 21 to 24, in the second member 2. In particular, as the number, size, or weight of members is not increased or another member is not added, the joining strength between the first member 1 and the second member 2 can be improved without increasing the weight of the members.

Since the corner portions 25 to 28 are enlarged and deformed using the elastic bodies 3 disposed in the corner portions 25 to 28, the corner portions 25 to 28 can be uniformly deformed. Consequently, the fitting accuracy between the first member 1 and the second member 2 is improved, thereby making it possible to improve the joining strength between the first member 1 and the second member 2.

By arranging the core member 4 at the straight line portions 21 and 22, each having a predetermined length or more, the corner portions 25 to 28 having a higher caulking holding force than the straight line portions 21 and 22 are deformed concentratedly without deforming the straight line portions 21 and 22 which are more likely to elastically buckle by an in-plane compressive force generated at the time of caulking. Consequently, the joining strength between the first member 1 and the second member 2 can be improved.

When the length of each of the straight line portions 21 and 22 is larger than the effective width B of the first member 1, the first member 1 tends to elastically buckle in a region spaced apart by half the effective width B, i.e., B/2 only from each of both ends of the straight line portions 21 and 22. Because of this, the core member 4 is arranged in this region, thereby preventing the second member 2 from being enlarged and deformed in the region, which can also prevent the first member 1 from elastically buckling in the region.

The region where each elastic body 3 is arranged is set to at least the joint portion 1*a* between the first member 1 and the second member 2, thereby making it possible to reduce the necessary amount of the elastic bodies 3. Furthermore, the size of each elastic body 3 is set smaller, so that the corner portions 25 to 28 can be uniformly and more easily deformed using the elastic bodies 3.

The cross-sectional shape of the second member 2 is similar to the cross-sectional shape of each of the first hole portions 17 and 18 in the first member 1. Thus, the corner portions 25 to 28 of the second member 2 can be uniformly enlarged and deformed, thus making it possible to suppress the occurrence of a local load on the first member 1 and the second member 2.

The amount of enlarged deformation of the second member 2 at the corner portions 25 to 28 is larger than the amount of enlarged deformation of the second member 2 at the straight line portions 21 and 22 on the long side. That is, the amount of enlarged deformation of the corner portions 25 to 28, each of which has a higher caulking holding force than the straight line portions 21 and 22, is set large. Because of this, the joining strength between the first member 1 and the second member 2 can be improved. Furthermore, the amount of enlarged deformation of the second member 2 toward the first member 1 decreases from the corner portions 25 to 28 toward the center in the longitudinal direction of the straight line portions 21 and 22 on the long side, thereby making it possible to improve the fitting accuracy between the first member 1 and the second member 2 at the corner portions 25 to 28. Consequently, the joining strength between the first member 1 and the second member 2 can be improved.

Second Embodiment

Figure 5:
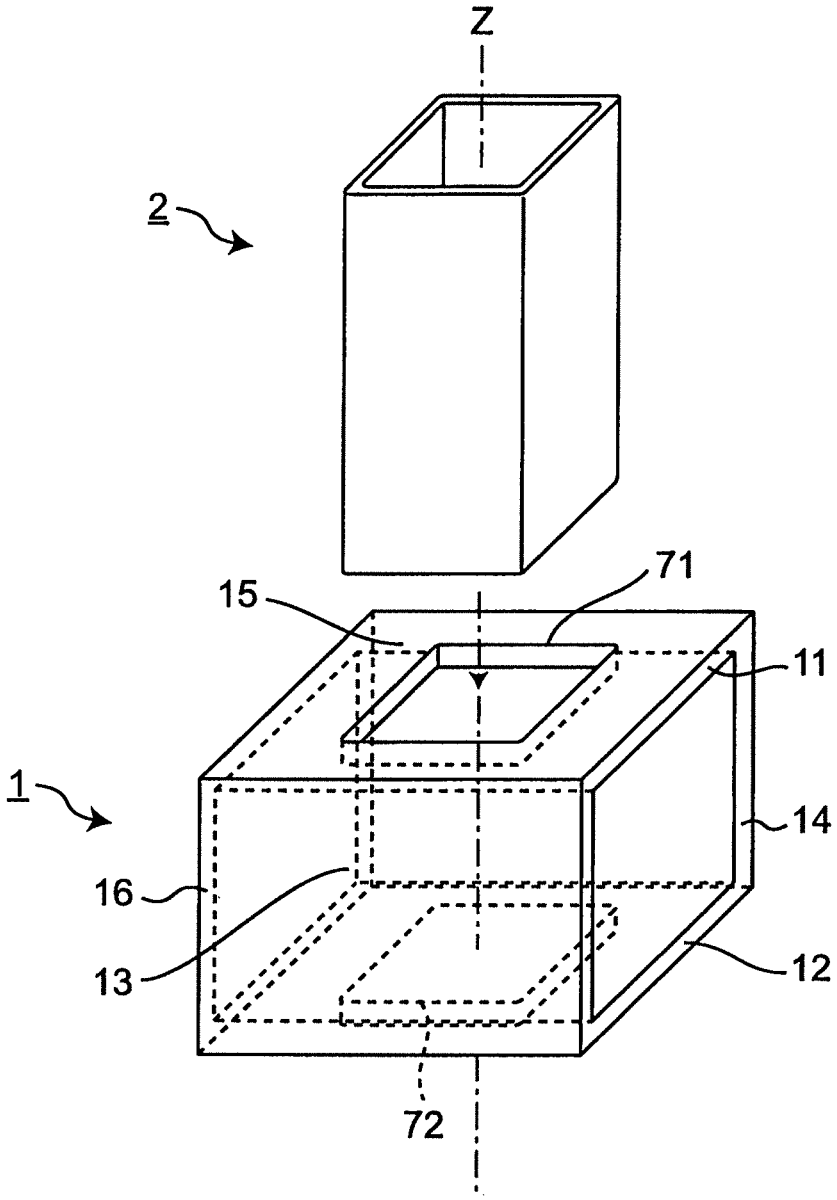
FIG. 5 is a perspective view illustrating joining between a first member and a second member according to a second embodiment of the present invention.

FIG. 5 is a perspective view illustrating joining between the first member and the second member according to a second embodiment of the present invention. The second embodiment differs from the first embodiment in the cross-sectional shape of each of the first hole portions 71 and 72 of the first member 1 and in the cross-sectional shape of the second member 2, and is similar to the first embodiment in other structures. Thus, in the description of the second embodiment, the same components or parts as those in the first embodiment are denoted by the same reference characters, and a detailed description thereof is omitted below.

The upper wall 11 and the lower wall 12 of the first member 1 are provided with the first hole portions 71 and 72, respectively, into which the second member 2 is insertable.

Figure 6:
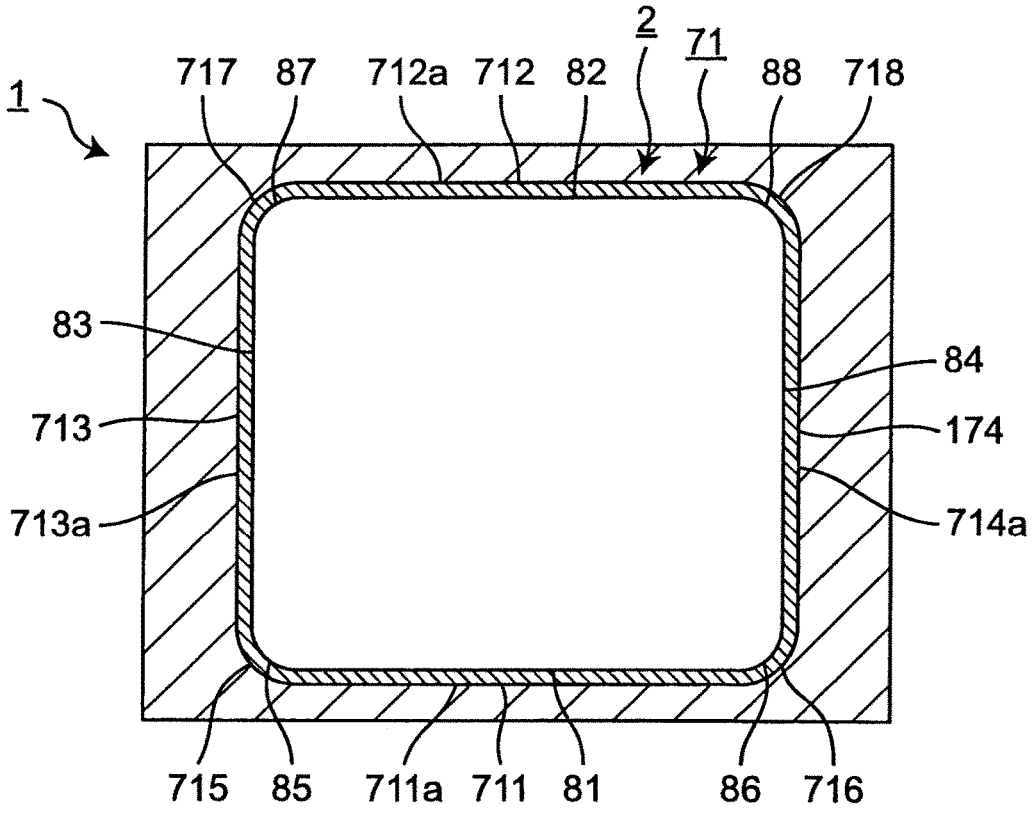
FIG. 6 is a cross-sectional view showing a horizontal cross-section of a first hole portion in a state where the second member is inserted into the first member.

FIG. 6 is a cross-sectional view showing a horizontal cross-section of the first hole portion 71 in a state where the second member 2 is inserted into the first member 1. As shown in FIG. 6, the first hole portion 71 has a rectangular cross-sectional shape that has long sides 711 and 712 and short sides 713 and 714. The long sides 711 and 712 include straight line portions 711*a* and 712*a* extending linearly, respectively. The short sides 713 and 714 include straight line portions 713*a* and 714*a* extending linearly, respectively. The first hole portion 71 includes a corner portion 715 positioned between the straight line portion 711*a* and the straight line portion 713*a*, a corner portion 716 positioned between the straight line portion 717*a* and the straight line portion 714*a*, a corner portion 717 positioned between the straight line portion 712*a* and the straight line portion 713*a*, and a corner portion 718 positioned between the straight line portion 712*a* and the straight line portion 714*a*. The four corner portions 715 to 718 each have an arc shape with the same curvature. It is noted that the first hole portion 72 has the same shape as the first hole portion 71.

The second member 2 has a rectangular cross-sectional shape corresponding to the rectangular cross-sectional shape of each of the first hole portions 71 and 72 so as to be insertable into the first hole portions 71 and 72. Specifically, the cross-sectional shape of the second member 2 is similar to the cross-sectional shape of each of the first hole portions 71 and 72, and is slightly smaller than the cross-sectional shape of each of the first hole portions 71 and 72.

The second member 2 includes straight line portions 81 to 84 extending linearly, and corner portions 85 to 88 positioned between the two straight line portions in the cross-sectional shape. In a state where the second member 2 is inserted into the first hole portions 71 and 72, the straight line portion 81 faces the straight line portion 711*a*, the straight line portion 82 faces the straight line portion 712*a*, the straight line portion 83 faces the straight line portion 713*a*, and the straight line portion 84 faces the straight line portion 714*a*. In the same state, the corner portion 85 faces the corner portion 715, the corner portion 86 faces the corner portion 716, the corner portion 87 faces the corner portion 717, and the corner portion 88 faces the corner portion 718. The four corner portions 85 to 88 each have an arc shape with the same curvature.

Each of the straight line portions 81 and 82 on the long side and the straight line portions 83 and 84 on the short side has a length that is equal to or more than the first length. The first length is equal to the effective width B of the first member 1. The effective width B of the first member 1 is determined in the same way as in the first embodiment.

Joining between the first member 1 and the second member 2 is performed in the following way.

Figure 7:
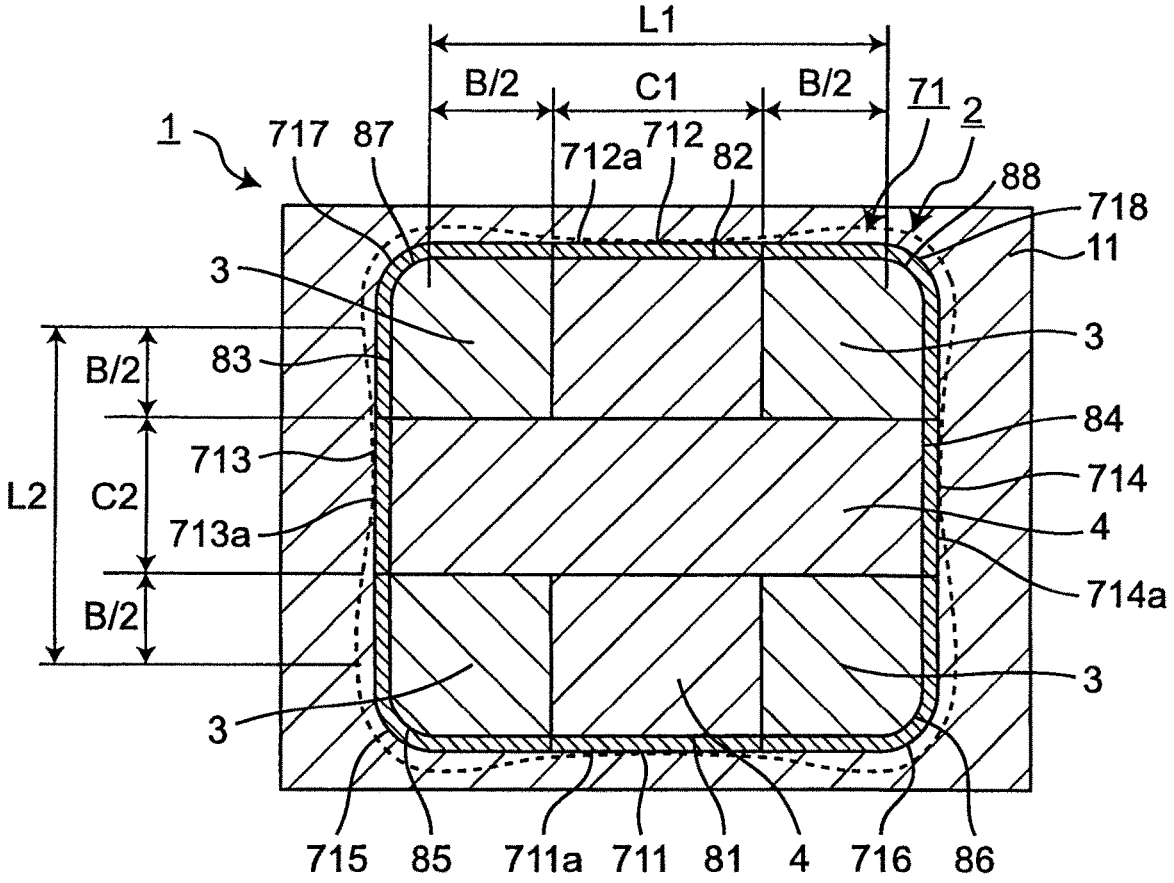
FIG. 7 is a cross-sectional view showing a horizontal cross-section of the first hole portion in a state where the second member is inserted into the first member, and further, elastic bodies and a core member are inserted into the interior of the second member.

First, as shown in FIG. 5, the second member 2 is inserted into the first hole portions 71 and 72 of the first member 1. Further, the elastic bodies 3 and the core member 4 are inserted into the interior of the second member 2. FIG. 7 is a cross-sectional view showing a horizontal cross-section of the first hole portion 71 in a state where the second member 2 is inserted into the first member 1, and further, the elastic bodies 3 and the core member 4 are inserted into the interior of the second member 2. As shown in FIG. 7, the elastic bodies 3 are disposed in the corner portions 85 to 88 of the second member 2, and the core member 4 is disposed at the straight line portions 81 and 82 on the long side and the straight line portions 83 and 84 on the short side, each straight line portion having a length equal to or more than the first length (effective width B of the first member 1). In particular, the core member 4 is disposed at the center in the longitudinal direction of the straight line portions 81 to 84.

The length C1 of the core member 4 in the longitudinal direction of each of the straight portions 81 and 82 is determined by formula (4) below:

[Equation 4]

$$C1 \geq L1 - B \tag{4}$$

where L1 is a length of each of the straight line portions 81 and 82.

The length C2 of the core member 4 in the longitudinal direction of each of the straight portions 83 and 84 is determined by formula (5) below:

[Equation 5]

$$C2 \geq L2 - B \quad (5)$$

where L2 is a length of each of the straight line portions 83 and 84.

Figure 8:
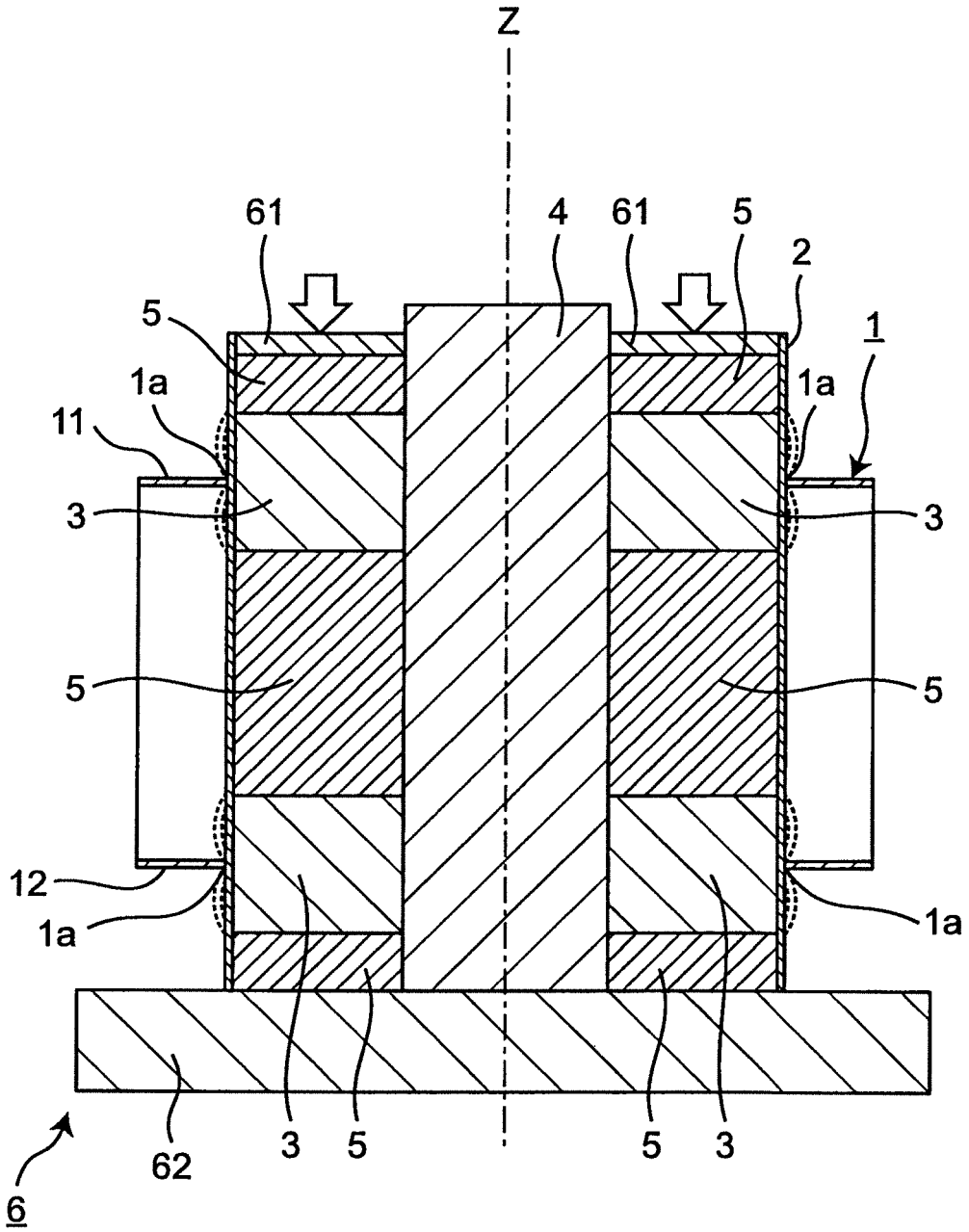
FIG. 8 is a longitudinal cross-sectional view showing a state where the second member is inserted into the first member, and further, the elastic bodies and the core member are inserted into the interior of the second member.

FIG. 8 is a longitudinal cross-sectional view showing a state where the second member 2 is inserted into the first member 1, and further, the elastic bodies 3 and the core member 4 are inserted into the interior of the second member 2. As shown in FIG. 8, the second member 2 passes through the first member 1. Further, the elastic bodies 3 are separated into top and bottom parts and arranged to extend only by a predetermined length along the insertion direction (axis Z direction) of the second member 2 and to cover the joint portions 1*a* between the first member 1 and the second member 2 at the corner portions 85 to 88. Core members 5 are respectively disposed above the elastic bodies 3 on the upper side, between the elastic bodies 3 on the upper side and the lower side, and below the elastic bodies on the lower side. Note that the core member 5 is not disposed at the joint portion 1*a* between the first member 1 and the second member 2. The core member 5 is formed of the same material as the core member 4 disposed at the straight line portions 81 to 84.

The second member 2 may be inserted into the first hole portions 71 and 72 in a state where the elastic bodies 3 and the core members 4 and 5 are inserted into the second member 2.

Then, the second member 2 into which the elastic bodies 3 and the core members 4 and 5 are inserted is set in a press device 6. The press device 6 includes an indenter 61 and a stand 62. The indenter 61 has a flat lower surface. The indenter 61 presses, with its lower surface, the elastic bodies 3 via the core members 5. The stand 62 has a flat upper surface. The elastic body 3 is placed on the upper surface of the stand 62 via the core member 5.

Then, an external compressive force is applied to the elastic body 3 in the axis Z direction by the press device 6. As the dimension in the axis Z direction of the elastic body 3 decreases, the dimension in the radial direction of the elastic body 3 increases. In this manner, the elastic body 3 is elastically deformed (expanded) outward from the axis Z, and as a result, the second member 2 into which the elastic bodies 3 are inserted is enlarged and deformed.

After the first member 1 and the second member 2 are joined together, the compressive force of the press device 6 is released. The elastic bodies 3 from which the compressive force has been released are restored to their original shape by their own elastic force, and are then removed from the second member 2. The core members 4 and 5 are also removed from the second member 2.

FIGS. 7 and 8 show, by dashed lines, a state in which the second member 2 is enlarged and deformed with respect to the first member 1 after the removal of the elastic bodies 3. As shown in FIG. 7, the amount of enlarged deformation of the second member 2 in the corner portions 85 to 88 is larger than the amount of enlarged deformation of the second member 2 in the straight line portions 81 to 84. In more detail, the amount of enlarged deformation of the second member 2 toward the first member 1 decreases from the corner portions 85 to 88 toward the center in the longitudinal direction of the straight line portions 81 to 84.

The joining method and joint structure between the first member 1 and the second member 2 with the above-mentioned configuration can exhibit the following effects.

By arranging the core member 4 at the straight line portions 81 to 84 on four sides, each having a predetermined length or more, the corner portions 85 to 88 having a higher caulking holding force than the straight line portions 81 to 84 are deformed concentratedly without deforming the straight line portions 81 to 84 which are more likely to elastically buckle by an in-plane compressive force generated at the time of caulking. Consequently, the joining strength between the first member 1 and the second member 2 can be improved. In particular, as the number, size, or weight of the members is not increased or another member is not added, the joining strength between the first member 1 and the second member 2 can be improved without increasing the weight of the members.

Since the corner portions 85 to 88 are enlarged and deformed using the elastic bodies 3 disposed in the corner portions 85 to 88, the corner portions 85 to 88 can be uniformly deformed. Consequently, the fitting accuracy between the first member 1 and the second member 2 is improved, thereby making it possible to improve the joining strength between the first member 1 and the second member 2.

The region where each elastic body 3 is arranged is located in at least the joint portion between the first member 1 and the second member 2, thereby making it possible to reduce the necessary amount of the elastic bodies 3. Furthermore, the size of each elastic body 3 is set smaller, so that the corner portions 85 to 88 can be uniformly and more easily deformed using the elastic bodies 3.

The cross-sectional shape of the second member 2 is similar to the cross-sectional shape of each of the first hole portions 71 and 72 in the first member 1. Thus, the corner portions 85 to 88 of the second member 2 can be uniformly enlarged and deformed, thus making it possible to suppress the occurrence of a local load on the first member 1 and the second member 2.

The amount of enlarged deformation of the second member 2 in the corner portions 85 to 88 is larger than the amount of enlarged deformation of the second member 2 in the straight line portions 81 to 84. That is, the amount of enlarged deformation of the corner portions 85 to 88, which has a higher caulking holding force than the straight line portions 81 and 84, is set large. Because of this, the joining strength between the first member 1 and the second member 2 can be improved. Furthermore, the amount of enlarged deformation of the second member 2 toward the first member 1 decreases from the corner portions 85 to 88 toward the center in the longitudinal direction of the straight line portions 81 and 84, thereby making it possible to improve the fitting accuracy between the first member 1 and the second member 2 in the corner portions 85 to 88. Consequently, the joining strength between the first member 1 and the second member 2 can be improved.

In the above-mentioned embodiment, the corner portions of the second member 2 are enlarged and deformed by compressing the elastic bodies 3 in the insertion direction (axis Z direction) of the second member 2. However, the means for enlarging and deforming the corner portion is not limited to the elastic body 3, and may be any means for enlarging and deforming the corner portion, such as application of pressure using a mold or the like.

Figure 9:
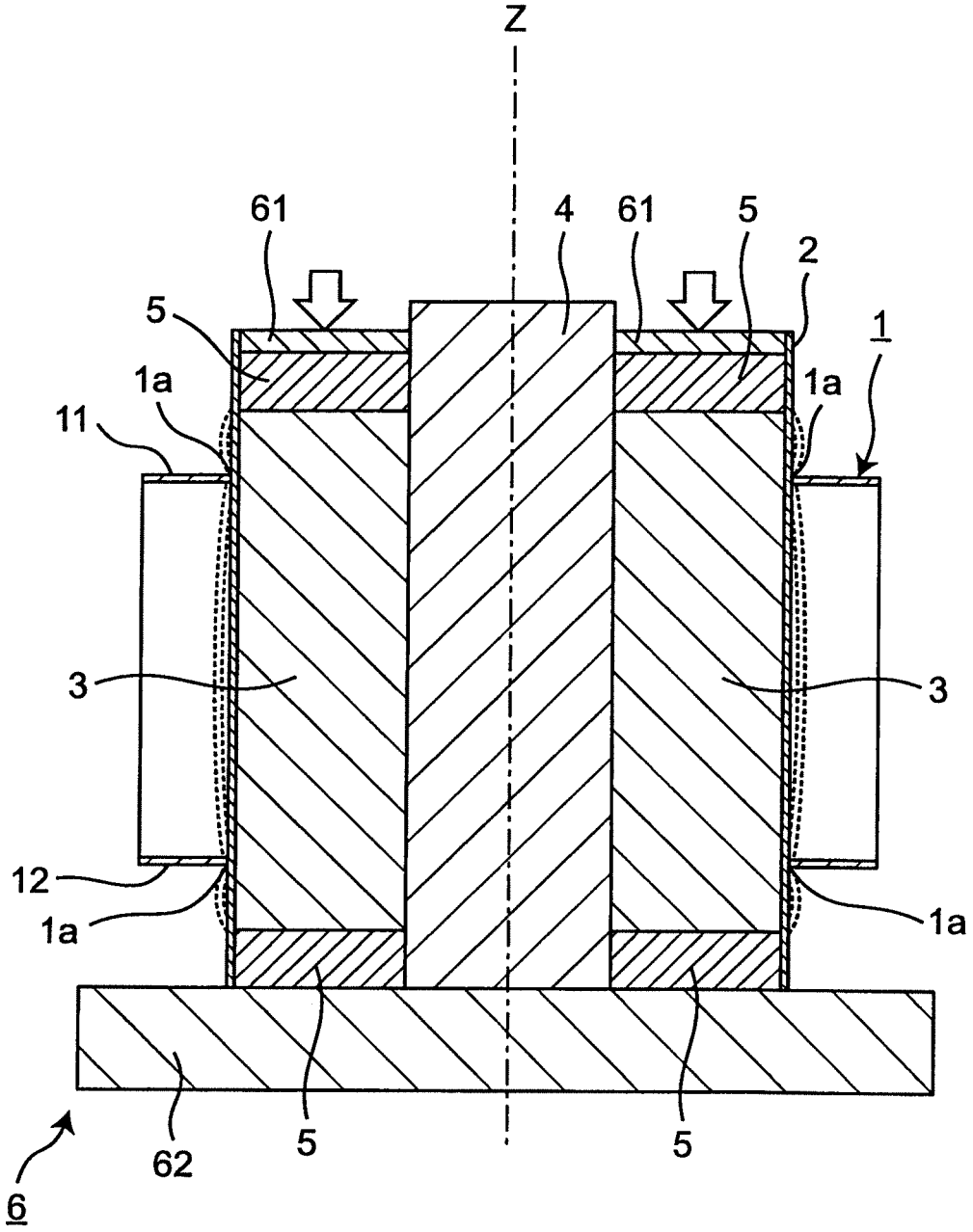
FIG. 9 is a longitudinal cross-sectional view showing a modification of the arrangement of the elastic bodies.

In the above-mentioned embodiments, the elastic bodies 3 are separated into top and bottom parts and arranged to extend by a predetermined length along the insertion direction (axis Z direction) of the second member 2 and to cover the joint portions 1*a* between the first member 1 and the second member 2 in the corner portions of the second member 2. However, as shown in FIG. 9, the elastic body 3 may be arranged over the entire length of each corner portion of the second member 2 between the joint portions 1*a*. In this case, the elastic bodies 3 need not be arranged to be separated into top and bottom parts, which can simplify an insertion procedure of the elastic body 3. FIG. 9 shows, by a dashed line, the state of enlarged deformation of the second member 2 with respect to the first member 1 after the removal of the elastic bodies 3.

In the above-mentioned embodiment, the effective width B of the first member is specified by the Karman equation on the assumption that the first member buckles elastically when the yield stress is reached, but may be derived based on another formula or other conditions.

In the above-mentioned embodiments, each of the first hole portions 17 and 18 of the first member 1 and the second member 2 has a rectangular cross-sectional shape. However, the shape of each of the first hole portions 17 and 18 and the second member 2 is not limited to the rectangular cross-sectional shape and may be a polygonal cross-sectional shape that has the straight line portions and the corner portions, such as a triangle cross-sectional shape, a square cross-sectional shape, a pentagonal cross-sectional shape, and a hexagonal cross-sectional shape. It is noted that the cross-sectional shape of the second member 2 only needs to have any shape that enables the second member 2 to be inserted into each of the first hole portions 17 and 18 having the polygonal cross-sectional shape and which has straight line portions corresponding to the straight line portions of the first hole portions 17 and 18 and corner portions corresponding to the corner portions of the first hole portions 17 and 18.

In the above-mentioned embodiment, the respective corner portions of the first member 1 have the arc shapes that have the same curvature, but may have arc shapes that have, for example, different curvatures. Likewise, the respective corner portions of the second member 2 have arc shapes that have the same curvature, but may have arc shapes that have, for example, different curvatures. Each of the corner portions of the first member 1 and the corner portions of the second member 2 may have a vertex with a predetermined angle. It is noted that as each of the corner portions of the second member 2 has the arc shape, the elastic bodies 3 can easily fill in the respective corner portions without any gap, and thereby the corner portions can be more uniformly enlarged and deformed through the compression of the elastic bodies 3.

When the length of the straight line portion of the second member 2 is the first length or less, the core member 4 does not need to be disposed. However, if the core member 4 is disposed, the core member 4 should be preferably disposed at the center in the longitudinal direction of the straight line portion in consideration of the fact that the first member easily buckles elastically in the region spaced away from each of both ends of the straight line portion only by half the effective width, i.e., B/2.

In the above-mentioned embodiment, the second member 2 is inserted into the first hole portions of the first member 1 and passes through the first member 1. However, the second member 2 may not pass through the entire first member 1. Specifically, the joint portion 1*a* between the first member 1 and the second member 2 only needs to be present, and, for example, the second member 2 may pass through only one of the first hole portions of the first member 1 while not passing through the other.

The present invention is not limited to the configurations mentioned in the above embodiments, and can include various modifications that could be conceived by a person skilled in the art without departing from the contents mentioned in claims.

The invention claimed is:

1. A joining method of members, which comprises the steps of:

preparing a first member in which a first hole portion having a polygonal cross-sectional shape is formed, and a second member having a hollow shape, wherein the second member has a cross-sectional shape corresponding to the polygonal cross-sectional shape of the first hole portion, the second member including a plurality of straight line portions extending linearly and a corner portion positioned between the adjacent two straight line portions in the cross-sectional shape;

inserting the second member into the first hole portion of the first member;

disposing an elastic body in the corner portions of the second member in such a manner that the elastic body has a surface extending in a direction perpendicular to an inserting direction of the second member; and applying a pressing force onto an entirety of the surface of the elastic body in the inserting direction of the second member such that the corner portion is enlarged and deformed in the direction perpendicular to the inserting direction of the second member so that the second member is caulked and joined to the first member.

2. The joining method according to claim 1, wherein the straight line portion has a length that is equal to or more than a first length, and a core member is disposed at the straight line portion.

3. The joining method according to claim 2, wherein the first length is equal to an effective width B of the first member, the effective width B is determined by formula (1) below, and a length C of the core member in a longitudinal direction of the straight portion is determined by formula (3) below:

$$B=\alpha\times\sqrt{E\times t}\sqrt{\sigma y} \quad (1)$$

$$0.9\leq\alpha\leq1.1 \quad (2)$$

$$C\geq L-B \quad (3)$$

where α is specified by formula (2), E is a Young's modulus of the first member, t is a plate thickness of the first member, σy is a yield stress of the first member, and L is a length of the straight line portion.

4. The joining method according to claim 1, wherein the elastic body is disposed in at least a joint portion between the first member and the second member in the corner portion.

5. A joint structure between a first member having a first hole portion and a second member having a hollow shape, the second member being inserted into the first hole portion, wherein the first hole portion has a polygonal cross-sectional shape, the second member has a cross-sectional shape corresponding to the polygonal cross-sectional shape of the first hole portion, the second member including a plurality of straight line portions extending linearly and a corner portion positioned between the adjacent two straight line portions in the cross-sectional shape, and an amount of enlarged deformation of the second member in at least the one corner portion is larger than an amount of enlarged deformation of the second member in the straight line on at least one side, wherein the straight line portion has a length that is equal to or more than a first length, and a core member is disposed at the straight line portion, the first length is equal to an effective width B of the first member, the effective width B is determined by formula (1) below, and a length C of the core member in a longitudinal direction of the straight portion is determined by formula (3) below:

$$B=\alpha\times\sqrt{E\times t/\sigma y} \quad (1)$$

$$0.9\leq\alpha\leq1.1 \quad (2)$$

$$C\geq L-B \quad (3)$$

where $\alpha$ is specified by formula (2), E is a Young's modulus of the first member, t is a plate thickness of the first member, $\sigma y$ is a yield stress of the first member, and L is a length of the straight line portion.

* * * * *